US009534786B2

(12) United States Patent
Sreekanth et al.

(10) Patent No.: US 9,534,786 B2
(45) Date of Patent: Jan. 3, 2017

(54) COMBUSTOR HEAT SHIELD

(71) Applicant: Pratt & Whitney Canada Corp., Longueuil (CA)

(72) Inventors: Sri Sreekanth, Mississauga (CA); Michael Papple, Verdun (CA); Robert Sze, Mississauga (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 320 days.

(21) Appl. No.: 14/455,159

(22) Filed: Aug. 8, 2014

(65) Prior Publication Data

US 2016/0040880 A1 Feb. 11, 2016

(51) Int. Cl.
*F23R 3/00* (2006.01)
*F23R 3/10* (2006.01)

(52) U.S. Cl.
CPC ..... *F23R 3/10* (2013.01); *F23R 2900/00005* (2013.01); *F23R 2900/03041* (2013.01)

(58) Field of Classification Search
CPC ..... F23R 3/002; F23R 3/005; F23R 3/10; F23R 3/26; F23R 2900/03041; F23R 2900/03042; F23R 2900/03044; F23R 2900/00005
See application file for complete search history.

(56) References Cited

U.S. PATENT DOCUMENTS

| | | | | |
|---|---|---|---|---|
| 5,542,246 | A | 8/1996 | Johnson et al. | |
| 5,758,503 | A | 6/1998 | DuBell et al. | |
| 6,032,457 | A * | 3/2000 | McKinney | F23R 3/10 60/740 |
| 2008/0104962 | A1* | 5/2008 | Patel | F23R 3/10 60/752 |
| 2011/0185739 | A1* | 8/2011 | Bronson | F02C 7/18 60/755 |
| 2011/0197590 | A1* | 8/2011 | Bottcher | F23R 3/002 60/752 |
| 2013/0055722 | A1* | 3/2013 | Verhiel | F23R 3/007 60/772 |

* cited by examiner

*Primary Examiner* — Ehud Gartenberg
*Assistant Examiner* — Filippo Manfredi
(74) *Attorney, Agent, or Firm* — Norton Rose Fulbright Canada LLP

(57) ABSTRACT

There is provided a combustor comprising a dome and a shell extending from the dome defining a combustion chamber. A dome heat shield is mounted to the dome inside the combustion chamber. A front heat shield is mounted to the shell and spaced therefrom. The dome heat shield has a lip extending generally away from the dome heat shield and generally parallel to the shell and spaced inwardly of the front heat shield to define a gap between the lip and the front heat shield. The front heat shield has a leading edge opposite the lip. The combustor has impingement holes extending through the shell and disposed to direct impingement cooling jets to the upstream portion of the front heat shield. The leading edge, of the front heat shield has at least one scallop defining an opening and disposed to allow the impingement cooling jets to impinge directly on a portion of the peripheral lip adjacent the scallop.

16 Claims, 4 Drawing Sheets

COMBUSTOR HEAT SHIELD

TECHNICAL FIELD

The application relates generally to gas turbine engines and, more particularly, to combustor heat shields.

BACKGROUND OF THE ART

Combustor heat shields provide protection to the combustor shell. Combustor dome heat shields may be provided with radially inner and outer lips. These lips are exposed to high gas temperature relative to the remainder of an otherwise well-cooled heat shield, resulting in hot spots with high thermal gradients. The thermal gradient inevitably results in cracks due to thermal mechanical fatigue. Cracking in the lips further deteriorates cooling effectiveness and results in additional damage due to high temperature oxidation. The front heat shields mounted to the combustor shells adjacent to the dome heat shields have leading edge portions adjacent to the lips of the dome heat shields that may be starved from cooling air and develop hot spots as well.

Accordingly, there is a need for an improved cooling scheme while avoiding any detrimental effect on the rest of the heat shield surface cooling.

SUMMARY

In one aspect, there is provided a gas turbine engine combustor comprising a dome and a shell extending from the dome, the dome and shell cooperating to define a combustion chamber within them, a dome heat shield mounted to the dome inside the combustion chamber, a front heat shield mounted to the shell inside the combustion chamber, the dome heat shield having a peripheral lip extending generally away from the dome heat shield and generally parallel to the shell and spaced inwardly of the front heat shield to define a gap between the peripheral lip and the front heat shield, at least one circumferentially arranged row of impingement holes extending through the shell and disposed to direct impingement cooling jets towards a leading edge of the front heat shield, the cooling jets generally aligned with the peripheral lip, and the leading edge of the front heat shield having at least one peripheral edge scallop defining an opening through the leading edge and disposed to allow the impingement cooling jets to impinge directly on a portion of the peripheral lip adjacent the scallop.

In a second aspect, there is provided a heat shield arrangement for a gas turbine engine combustor having an annular dome and inner and outer shells extending from the annular dome, the annular dome and the inner and outer shells defining a combustion chamber; the heat shield arrangement comprising: a dome heat shield adapted to be mounted to the dome inside the combustion chamber, said dome heat shield having inner and outer lips parallel and spaced from the inner and outer shells respectively; at least two front heat shields adapted to be mounted to the inner and outer shells respectively; the front heat shields having upstream portions terminating in leading edges so as to define an inner gap and an outer gap with the inner lip and outer lip respectively; the combustor having at least one circumferentially arranged row of impingement holes through the inner and outer shells and disposed to direct impingement cooling jets to the upstream portions of the front heat shields respectively; and the leading edges, of the front heat shields having scallops defining openings allowing the impingement cooling jets to impinge selected portions of the inner and outer lips.

In a third aspect there is provided a method for allowing cooling of hot spots occurring in selected portions of a lip of a dome heat shield mounted in a spaced relationship to the dome of a combustor in a gas turbine engine, the combustor having a shell depending from the dome and at least one front heat shield mounted to and spaced from the shell; the method including the steps of: providing for the formation of a starter film of cooling air, from the dome cooling air, to pass through a gap formed between the lip and the front heat shield; determining a hot spot in an area of the lip, selecting an area of the front heat shield corresponding to a radial projection of the hot spot on the lip; cutting out a scallop along a leading edge of the front heat shield at the selected area of the front heat shield; and providing impingement holes in the shell in an area surrounding the leading edge of the front heat shield, whereby the impingement jets of cooling air can pass by the scallop to impinge on the hot spot area of the lip.

In a fourth aspect, there is provided a method of cooling a dome heat shield having front and back surfaces mounted in a combustor of a gas turbine engine, the dome heat shield having a lip; the method comprising: recuperating air leaking from a combustor dome portion, and directing the leakage air in a gap defined by the lip and a front heat shield mounted in a spaced apart manner to a shell of the combustor; determining the location of hot spots on the lip and a leading edge of the front heat shield; forming scallops in the leading edge of the front heat shield to provide openings allowing impingement air to pass by the front heat shield and impinge the hot spots on lip.

DESCRIPTION OF THE DRAWINGS

Reference is now made to the accompanying figures, in which.

DETAILED DESCRIPTION

Figure 1:
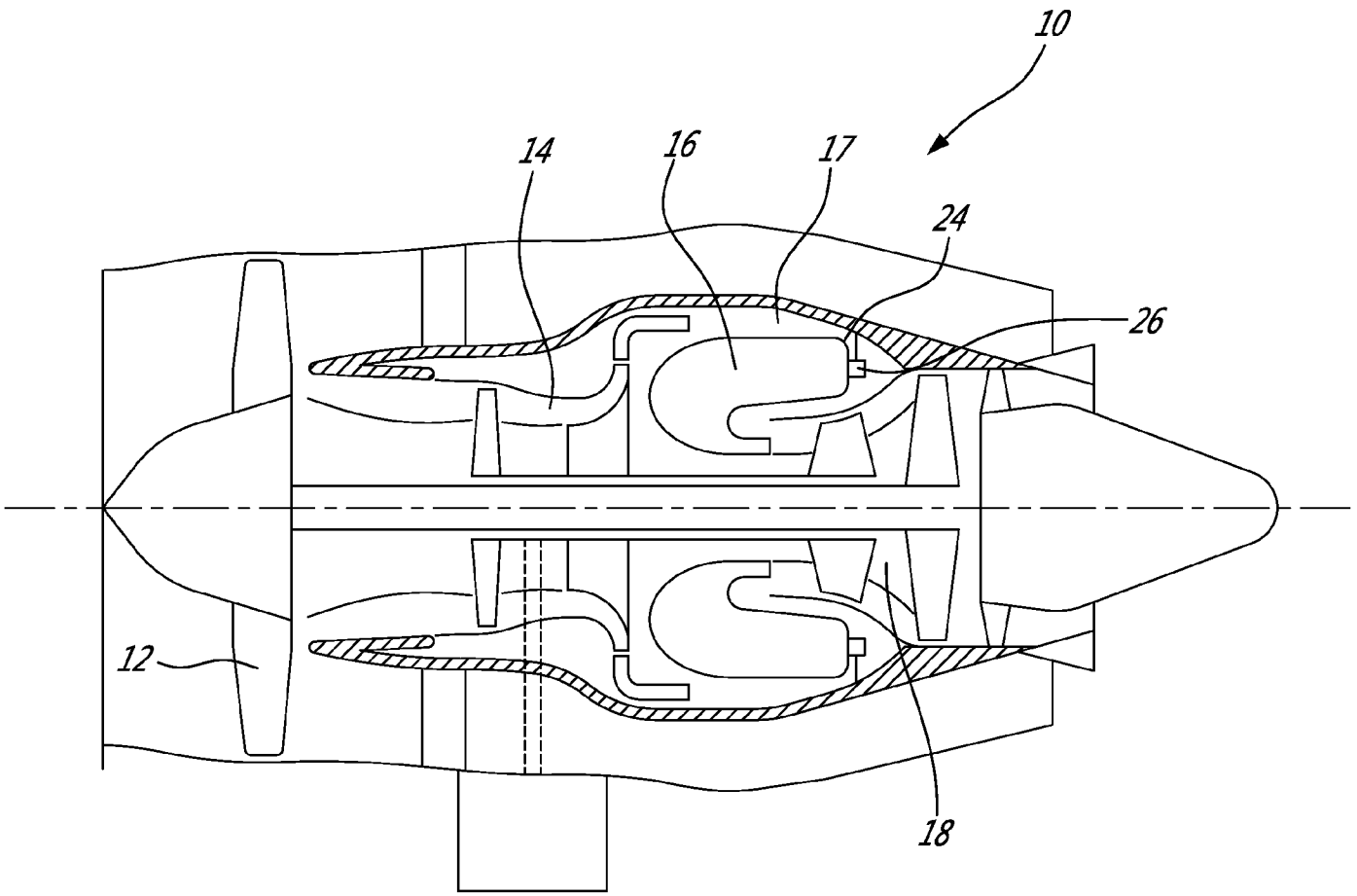
FIG. 1 is a schematic, cross-sectional view of a turbofan engine having a reverse flow annular combustor.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
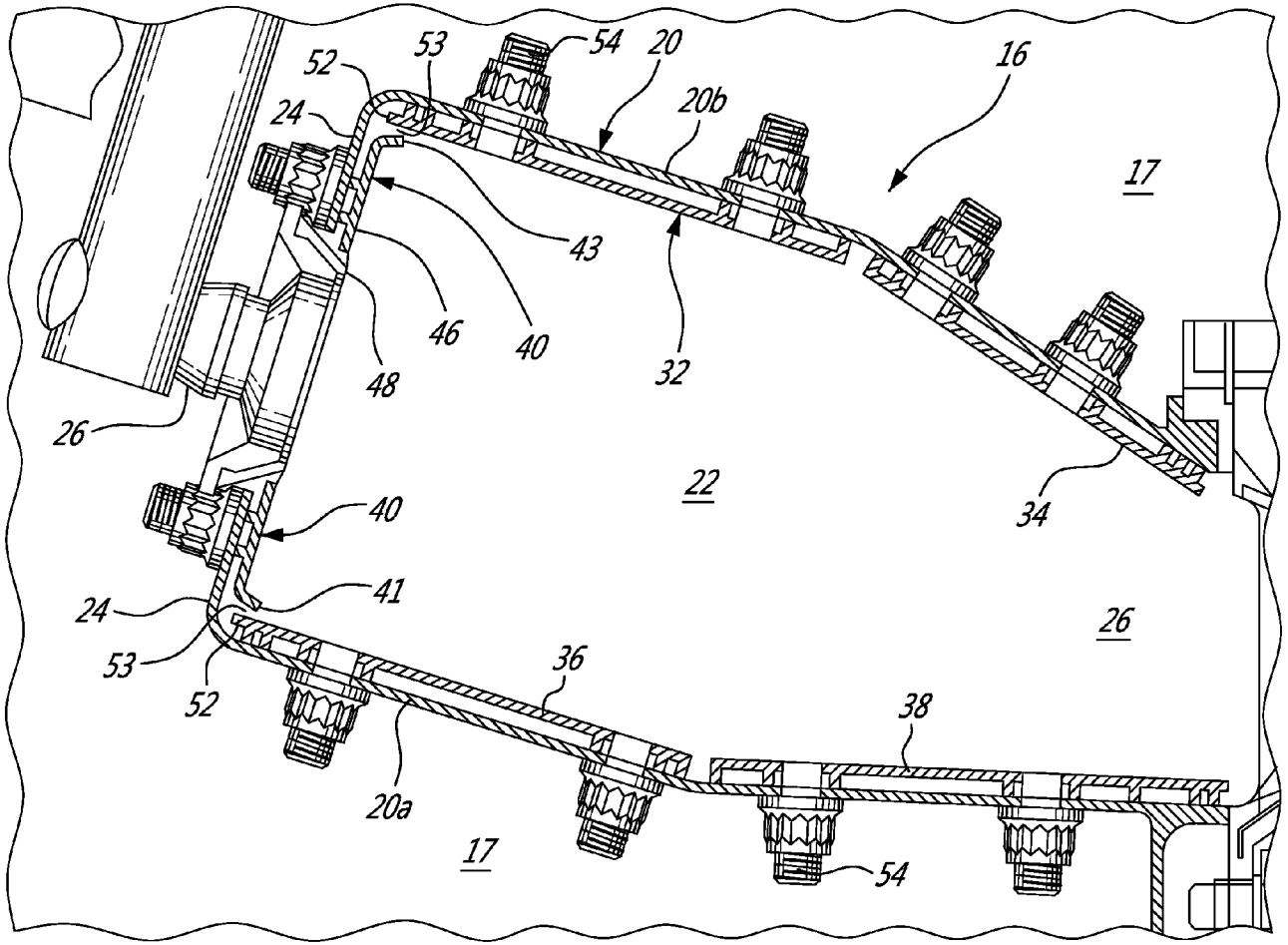
FIG. 2 is a schematic view of the combustor of the engine shown in FIG. 1.

The combustor 16 is housed in a plenum 17 supplied with compressed air from compressor 14. As shown in FIG. 2, the combustor 16 may comprise an annular combustor shell 20 including a radially inner shell 20*a* and a radially outer shell 20*b*, defining a combustion chamber 22. The combustor 16 has a bulkhead or inlet dome portion 24. The combustor 16 further has an exit portion 26 for communicating combustion gases with the turbine section 18. As shown in FIG. 1, a plurality of fuel nozzles 26 are mounted to extend through the dome portion 24 of the combustor 20 to deliver a fuel-air mixture to the combustion chamber 22.

A plurality of impingement holes 28 (FIG. 3) may be defined in the inner and outer shells 20*a* and 20*b* for cooling purposes, and dilution holes (not shown) may also be provided for combustion purposes. Inner and outer shells 20*a* and 20*b* may have any suitable configuration. The inner and outer shells 20*a* and 20*b* are typically made out of sheet metal, though any suitable material(s) and manufacturing method(s) may be used.

Referring to FIG. 2, it can be appreciated that circumferentially distributed dome heat shields 40 (only one shown in FIG. 2) are mounted to the dome portion 24, inside the combustion chamber 22, to protect the dome portion 24 from the high temperatures in the combustion chamber 22. The dome heat shields 40 are typically castings made out of high temperature capable materials. Now referring to FIGS. 2 and 3, it can be seen that each individual heat shield 40 is provided with radially spaced inner and outer lips 41 (not shown in FIG. 3) and 43 projecting forwardly from the front or hot face 46 of the heat shield 40. Circumferentially spaced-apart fuel nozzle openings 48 are defined through the combustor dome portion 24 for allowing mounting of the fuel nozzles 26 to the combustor 16.

Figure 3:
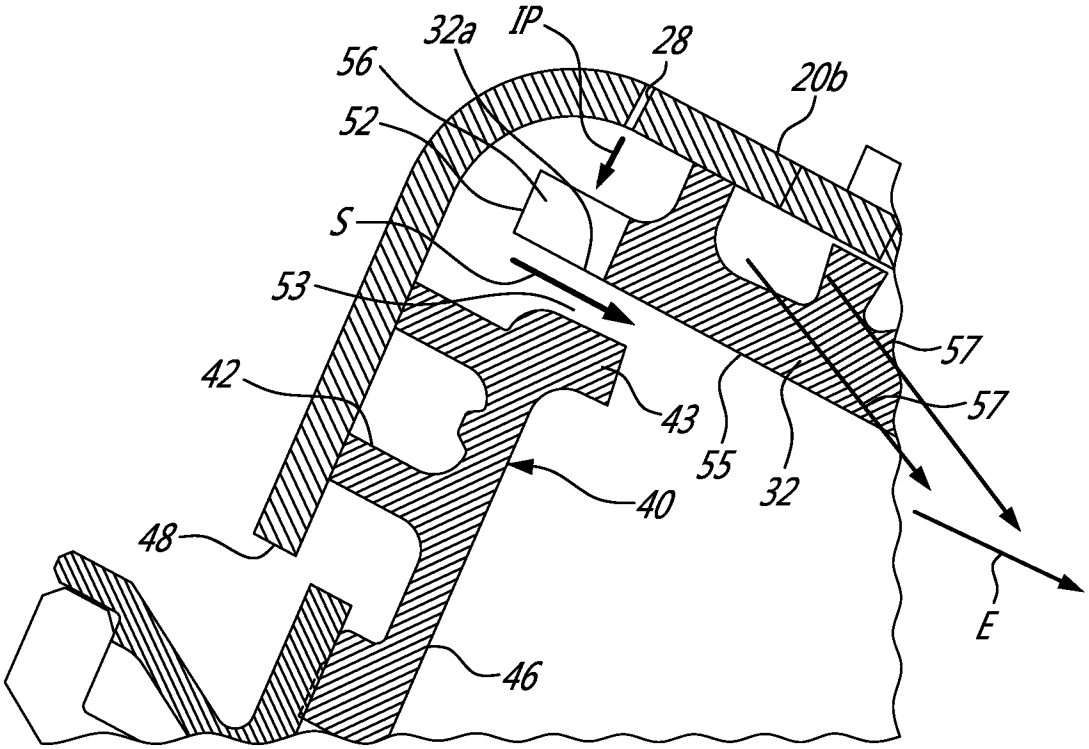
FIG. 3 is an enlarged, fragmentary view of a detail taken from FIG. 2.
Figure 4A:
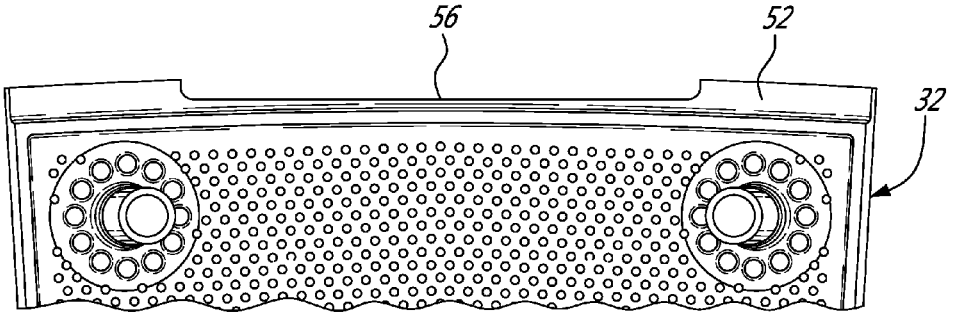
FIG. 4*a* is a front, fragmentary view of a detail of a heat shield shown in FIG. 2.

Each of the inner and outer shells 20*a* and 20*b* are provided with heat shields. In FIG. 2 the outer shell 20*b* is provided with front heat shields 32 and rear heat shield panels 34 while the inner shell 20*a* mounts front heat shields 36 and rear heat shields 38. Each front heat shield 32 and 36 has a leading edge 52. The heat shields 32, 34, 36 and 38 also include threaded studs 54 for mounting to the inner and outer shells 20*a*, 20*b* as shown in FIGS. 3 and 4*a* for the purpose of providing an air space for cooling air between the heat shields and the inner and outer shells 20*a*, 20*b*.

All front heat shields 32, 36 are cooled by effusion holes 57 extending therethrough. The holes are discrete holes of about 0.020" to 0.030" at an angle of 20°-40° with respect to the heat shield surface 55. The coolant air from the rows of effusion holes 57 accumulate to form an effusion film E at the front surface 55 to cool the hot face of the heat shields 32, 36.

As shown with respect to front heat shield 32, a narrow gap 53 is formed between the upstream portion 32*a* of the heat shield 32 and the lip 43. The same applies to front heat shield 36. The portion 32*a* of the heat shield 32, upstream of the first row of effusion holes 57, is not otherwise cooled. Starter film S, spent coolant from the dome heat shield 40, passes through the gap 53, to protect the upstream portion 32*a* of the heat shield 32 and make the rest of the effusion film E more effective. Since the starter film S is spent flow from the dome heat shield 40, there is no additional compromise to the engine.

Nevertheless, hotspots may occur on the lips 41, 43 as well as on the leading edge 52 of the front heat shields 32, 36. The hotspot profiles could be elliptical or rectangular. Some of the hotspots may be wider, some smaller, as indicated by thermal paint which may be provided on the dome heat shield lips 41 and 43.

In order to remedy the problem of hotspots on the lips 41, 43 or the leading edge 52, it has been found that by executing cut-out portions, scallops or scalloped slots 56, 156, 256 in the periphery of the heat shield at the leading edge 52, corresponding as a radial projection to the profiles of the hotspots occurring on the lip 43, for instance, impingement jets IP, defined radially through the shell 20*b*, can pass through the scalloped slots 56, 156, 256 and impinge directly upon a selected hotspot area on the lips 41, 43, to cool the area. The scallop slots 56, 156, 256 may be 1.5-2× the length and width of the corresponding hot spot depending on the space available. The hotspot location and size may vary from engine to engine depending on hardware tolerance.

Referring to FIG. 4*a*, it is known that a slot with a small or tight radius will normally lead to higher stress, resulting in local cracking. To avoid local cracking the scallop slot 56 is relatively long so that it extends well beyond the hot spot to regions where the metal temperature and the stresses are lower. This is particularly useful when dealing with large hot spots.

Figure 4B:
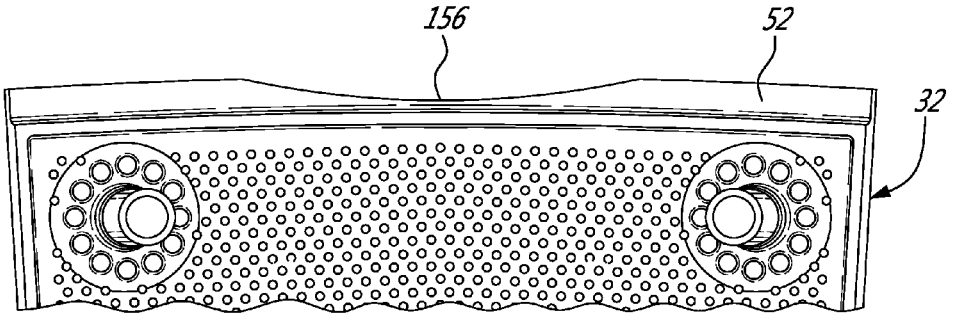
FIG. 4*b* is a front, fragmentary view of a detail of a heat shield similar to that shown in FIG. 4*a* but showing another embodiment.
Figure 4C:
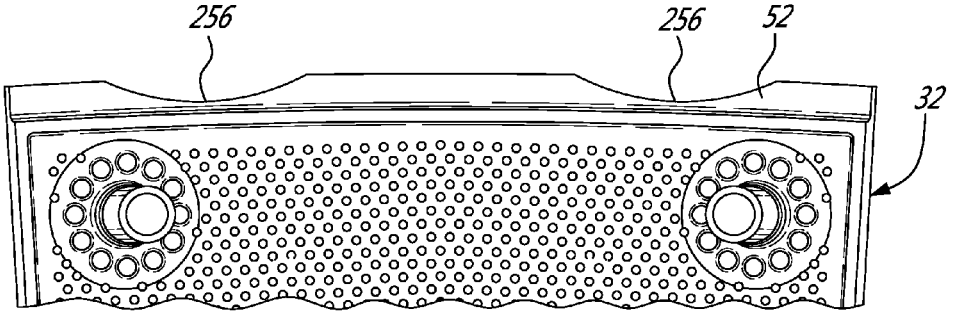
FIG. 4*c* is a front, fragmentary view of a detail of a heat shield similar to that shown in FIG. 4*a* but showing yet another embodiment.

If the corresponding hot spot is small, a slot with concave ends having a larger radius will provide a smoothly curved scallop slot 156 or 256, as shown in FIGS. 4*b* and 4*c*, is adequate.

Since the leading edge 52 of the front heat shields 32, 36 and the lips 41, 43 of the dome heat shields 40 are at the same area of the combustor, they are both subjected to the same heat load but slightly offset, due to the aerodynamics. Hot spots might occur both on the leading edge 52 and on a corresponding location on the dome heat shield lips. If a scalloped slot 56, 156, 256 is cut-out on the leading edge 52 of the front heat shields 32, 36 the hot spot on leading edge 52 is eliminated and the impingement jet would be allowed to impact the dome lip 41, 43.

In operation, coolant air from the plenum 17 leaks to the combustor dome portion 24 and the dome heat shield 40. This leakage air is recuperated and guided to cool the dome heat shield 40. Spent cooling air from the dome heat shield 40 will divert through the gap 53 forming a starter film S. The starter film can cool the portion of the front heat shield 32, 36 upstream of the effusion holes 57. A portion of the leakage air passes through the effusion holes 57. In addition, scalloped slots 56, 156 and 256 may be cut-out at the leading edge 52 of the front heat shield 32 to allow impingement air to selectively impinge on hot spots located on the lip 43.

The above description is meant to be exemplary only, and one skilled in the art will recognize that changes may be made to the embodiments described without departing from the scope of the invention disclosed. For example, the invention can be provided in any suitable heat shield configuration and in any suitable combustor configuration, and is not limited to application in turbofan engines. It is understood that the principles of the inventions are not limited to combustor dome heat shields. For instance, the scalloped slots, cut out on the leading edge of the front heat shields could be applied to other types of the combustor heat shields. Still other modifications which fall within the scope of the present invention will be apparent to those skilled in the art, in light of a review of this disclosure, and such modifications are intended to fall within the appended claims.

What is claim is:

1. A gas turbine engine combustor comprising a dome and a shell extending from the dome, the dome and shell cooperating to define a combustion chamber within them, a dome heat shield mounted to the dome inside the combustion chamber, a front heat shield mounted to the shell inside the combustion chamber, the dome heat shield having a peripheral lip extending generally away from the dome heat shield and generally parallel to the shell and spaced inwardly of the front heat shield to define a gap between the peripheral lip and the front heat shield, at least one circumferentially arranged row of impingement holes extending through the shell and disposed to direct impingement cooling jets towards a leading edge of the front heat shield, the cooling jets generally aligned with the peripheral lip, and the leading edge of the front heat shield having at least one peripheral edge scallop defining an opening through the leading edge and disposed to allow the impingement cooling jets to impinge directly on a portion of the peripheral lip adjacent the scallop.

2. The combustor as defined in claim 1, wherein the front heat shield is provided with effusion holes extending at an angle downstream of the leading edge, the effusion holes defining the limit of an upstream portion of the front heat shield.

3. The combustor as defined in claim 1, wherein the scallop is cut out in an area of the front heat shield at the leading edge thereof wherein the area is a radial projection of the portion of the peripheral lip.

4. The combustor as defined in claim 3, wherein the portion of the peripheral lip defines a hot spot.

5. The combustor as defined in claim 4, wherein the portion of the peripheral lip has a geometric area.

6. The combustor as defined in claim 5, wherein the scallop is an area between 1.5 and 2 times the geometric area.

7. The combustor as defined in claim 6, wherein the scallop is a cut-out from the leading edge terminating in concave end portions each having a similar radius of curvature.

8. The combustor as defined in claim 7, wherein the concave ends have a radius and the slot has a length sufficient to avoid stress cracking at the concave ends.

9. The combustor as defined in claim 7, wherein the concave ends have a radius sufficient to avoid stress cracking.

10. The combustor as defined in claim 2, wherein the axis of each effusion hole extends at an angle of between 20° and 25° to the plane of the front heat shield.

11. A heat shield arrangement for a gas turbine engine combustor having an annular dome and inner and outer shells extending from the annular dome, the annular dome and the inner and outer shells defining a combustion chamber; the heat shield arrangement comprising: a dome heat shield mounted to the dome inside the combustion chamber, said dome heat shield having inner and outer lips parallel and spaced from the inner and outer shells respectively; at least two front heat shields mounted to the inner and outer shells respectively; the front heat shields having upstream portions terminating in leading edges so as to define an inner gap and an outer gap with the inner lip and outer lip respectively; the combustor having at least one circumferentially arranged row of impingement holes through the inner and outer shells and disposed to direct impingement cooling jets to the upstream portions of the front heat shields respectively; and the leading edges, of the front heat shields having scallops defining openings allowing the impingement cooling jets to impinge selected portions of the inner and outer lips.

12. A method for cooling hot spots occurring in portions of a lip of a dome heat shield mounted in a spaced relationship to the dome of a combustor in a gas turbine engine, the combustor having a shell depending from the dome and at least one front heat shield mounted to and spaced from the shell; the method including the steps of providing for the formation of a starter film of cooling air, from the dome cooling air, to pass through a gap formed between the lip and the front heat shield; determining a hot spot in an area of the lip, selecting an area of the front heat shield corresponding to a radial projection of the hot spot on the lip; cutting out a scallop along a leading edge of the front heat shield at the selected area of the front heat shield; and providing impingement holes in the shell in an area surrounding the leading edge of the front heat shield, whereby the impingement jets of cooling air can pass by the scallop to impinge on the hot spot area of the lip.

13. The method as defined in claim 12, wherein the scallop is 1.5 to 2 times the area of the hot pot.

14. The method as defined in claim 12, wherein the scallop is cut out as a narrow elongated open portion from the leading edge, the scallop having concave corners, the scallop having a length sufficient to avoid local cracking at the corners.

15. The method as defined in claim 12, wherein the scallop is cut out as a relatively short elongated open portion from the leading edge, the scallop with gradual concave corners sufficient to avoid local cracking at the corners.

16. A method of cooling a dome heat shield having front and back surfaces mounted in a combustor of a gas turbine engine, the dome heat shield having a lip; the method comprising: recuperating air leaking from a combustor dome portion, and directing the leakage air in a gap defined by the lip and a front heat shield mounted in a spaced apart manner to a shell of the combustor; determining the location of hot spots on the lip and a leading edge of the front heat shield; forming scallops in the leading edge of the front heat shield to provide openings allowing impingement air to pass by the front heat shield and impinge the hot spots on lip.

* * * * *